United States Patent [19]

Mallard

[11] 4,221,241

[45] Sep. 9, 1980

[54] LUG STRAP CONNECTOR FOR LOOMS

[76] Inventor: Robert G. Mallard, Hopedale, Mass.

[21] Appl. No.: 57,196

[22] Filed: Jul. 13, 1979

Related U.S. Application Data

[63] Continuation-in-part of Ser. No. 923,095, Jul. 10, 1978, abandoned.

[51] Int. Cl.[3] ..... D03D 49/40

[52] U.S. Cl. ..... 139/151

[58] Field of Search ..... 139/151, 152, 153, 147, 139/149

[56] References Cited

U.S. PATENT DOCUMENTS

| | | | |
|---|---|---|---|
| 1,292,723 | 1/1919 | Demers | 139/151 |
| 2,173,776 | 9/1939 | Bowen | 139/151 |
| 2,430,226 | 11/1947 | Huffman | 139/151 |
| 2,996,841 | 12/1954 | Heim | 139/151 |
| 3,774,650 | 11/1973 | Sherrill et al. | 139/151 |

*Primary Examiner*—Henry Jaudon

*Attorney, Agent, or Firm*—Norman S. Blodgett; Gerry A. Blodgett

[57] ABSTRACT

A lug strap connector for looms comprising an elongated body of flexible material having a narrow central portion.

9 Claims, 5 Drawing Figures

LUG STRAP CONNECTOR FOR LOOMS

RELATIONSHIP TO CO-PENDING APPLICATIONS

This application is a continuation-in-part of patent application Ser. No. 923,095 filed July 10, 1978 now abandoned.

BACKGROUND OF THE INVENTION

The present invention relates generally to connecting mechanism in a loom between the pick arm which extends from the pick shaft and the lug strap mounted on the picker stick. The invention relates more specifically to a novel lug strap connector.

In conventional looms, the shuttle is propelled across the width of the loom alternately from one side of the loom to the other by means of a picker stick at each side of the loom. Each picker stick is pivoted near the bottom of the loom and has two pivoting motions. The first motion is a swinging motion toward the opposite side of the loom for propelling the shuttle through the warp shed. The second motion is a swinging motion backwardly and forwardly of the loom as it moves with the backwardly and forwardly reciprocating lay. The mechanism for imparting the shuttle-sticking motion or picking motion to the picker stick does not move with the lay and receives its driving power from the loom drive mechanism in synchronization with other loom motions. The picker-driving mechanism comprises a horizontal pick shaft which includes a horizontally-extending portion (commonly referred to as a "picking shoe") which is struck by a picking roll rotating on the bottom shaft of the loom. The picking shoe itself may be in the form of a flat cam-like surface or a conical surface. Regardless of the picking drive used, the pick shaft is given a sharp, abrupt oscillation at the time of picking. A pick arm extends from the pick shaft and is operatively connected to the picker stick through a connecting mechanism which includes the lug strap connector extending between the lug strap and the pick arm. The longitudinal axis of the pick shaft extends from front to rear of the loom, so that the pick arm oscillates or swings in a plane which is parallel to the front of the loom. The picker stick also swings in this plane and also in a second plane which is parallel to the sides of the loom and is at a right angle to the first plane. The lug strap connector is rigidly clamped to the lug strap and is pivotally connected to the pick arm. This means that there is relative displacement between the pick arm and lug strap connector from their common pivoting point in the first plane when the picker stick is moved for a shuttle-picking operation. There is also relative displacement between the lug strap connector and the pick arm as the picker stick moves backwardly and forwardly during its motion with the lay in the second plane.

The composite differential displacement between the picker stick and pick arm is provided for in present loom designs in part by the looseness of the lug strap and a universal connection between the lug strap connector and the pick arm. A typical universal connection is in the form of a ball joint. Connections of this type are costly, require frequent lubrication, and tend to wear, thereby producing irregularities in picking. The added mass of the ball joint connection also creates additional stress and wear in existing checking or motion dampening mechanism associated with picking. In some looms the differential motion has been taken care of by using loose or large tolerance connections to the pick arm. This causes force or power losses during picking and also results in irregular picking. These and other difficulties experienced by the prior art devices have been obviated in a novel manner by the present invention.

It is, therefore, an outstanding object of the invention to provide a lug strap connector which provides consistent shuttle picking.

Another object of this invention is the provision of a lug strap connector which requires a minimum of maintenance.

A further object of the present invention is the provision of a lug strap connector which is inexpensive, simple to manufacture, and easy to assemble.

It is another object of the instant invention to provide a lug strap connector which is long lasting and reliable.

A still further object of the invention is the provision of a lug strap connector which has a smaller mass than that of conventional connectors, thereby creating less stress on the checking mechanism.

With these and other objects in view, as will be apparent to those skilled in the art, the invention resides in the combination of parts set forth in the specification and covered by the claims appended hereto.

SUMMARY OF THE INVENTION

In general, the invention consists of a lug strap connection which includes a pick arm fixed to the picking shaft and a lug strap connector clamped at one end to a lug strap and pivotally connected at its other end to the pick arm, wherein the lug strap connector is sufficiently resilient to compensate for the backward and forward displacement of the picker stick during its reciprocation with the lay. Specifically, the invention provides for a lug strap connector which is constructed of a resilient material, such as a high density polymer, such as the high molecular weight polyethylene known as "ultra-high molecular weight linear polyethylene", or nylon, and has a rib-like, reduced central portion to aid the lug strap connector in flexing. The pivotal connection between the lug strap connector and the pick arm consists of a bushing that extends in a sliding fit within a hole in the connector and a bolt which extends through bifurcated end portions of the pick arm and bushing. The bushing is slightly longer than the hole in the connector, so that tightening of a nut on the end of the bolt serves to clamp the ends of the pick arm against the ends of the bushing. This means that during shuttle picking, the connector rotates on the bushing.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
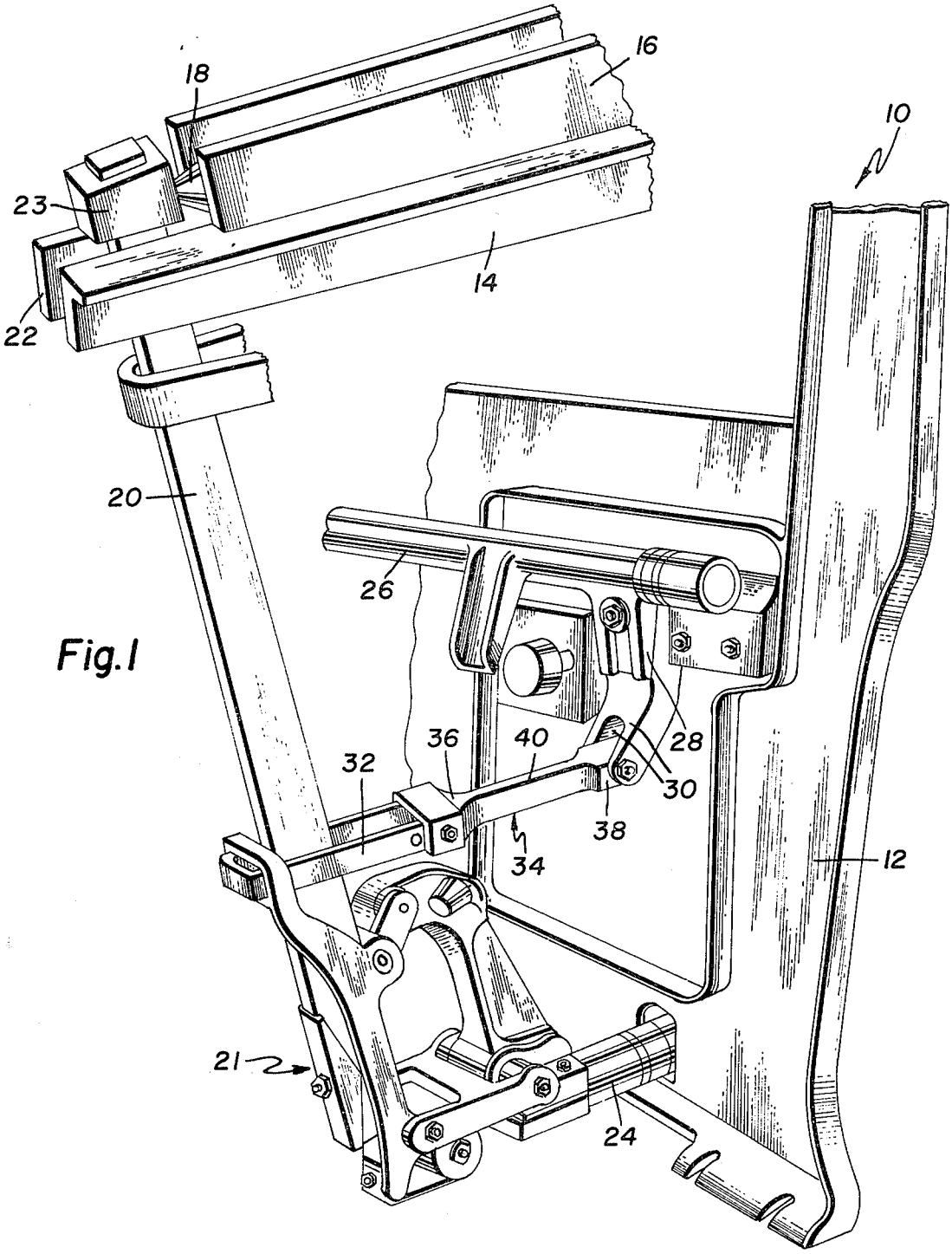
FIG. 1 is a fragmentary perspective of a picking mechanism showing a lug strap connector embodying the principles of the present invention.

Referring first to FIG. 1, there is shown a portion of a loom, indicated generally by reference numeral 10, comprising a loom side 12, a lay 14, with a shuttle box 16 mounted thereon for housing a shuttle 18. A picker stick 20 is pivotally mounted outside of and at the base of the loom side 12 by a mechanism generally indicated by the reference numeral 21. Picker stick 20 is slidably mounted within a slot 22 in the lay for reciprocation with the lay and includes a picker head 23 attached to the upper end of the picker stick above the slot 22 for engagement with the shuttle 18.

The picker stick pivoting mechanism 21 shown in FIG. 1, comprises a parallel linkage mechanism of a type commonly used in looms, which causes the picker head 23 to move along a straight horizontal line during a shuttle-picking sequence. However, the invention is not limited to any particular type of parallel picking motion and may include simple pivots as well. Regardless of the type of pivoting motion used for the picker stick, the picker stick must be mounted so that it can move in two vertical planes, the first of which extends across the width of the loom and the second of which extends lengthwise of the loom from front to back. The picker stick is allowed to move in this first plane by means of the pivoting mechanism 21 and swings in the second plane by means of a rocker shaft 24 which supports the pivoting mechanism 21.

Figure 2:
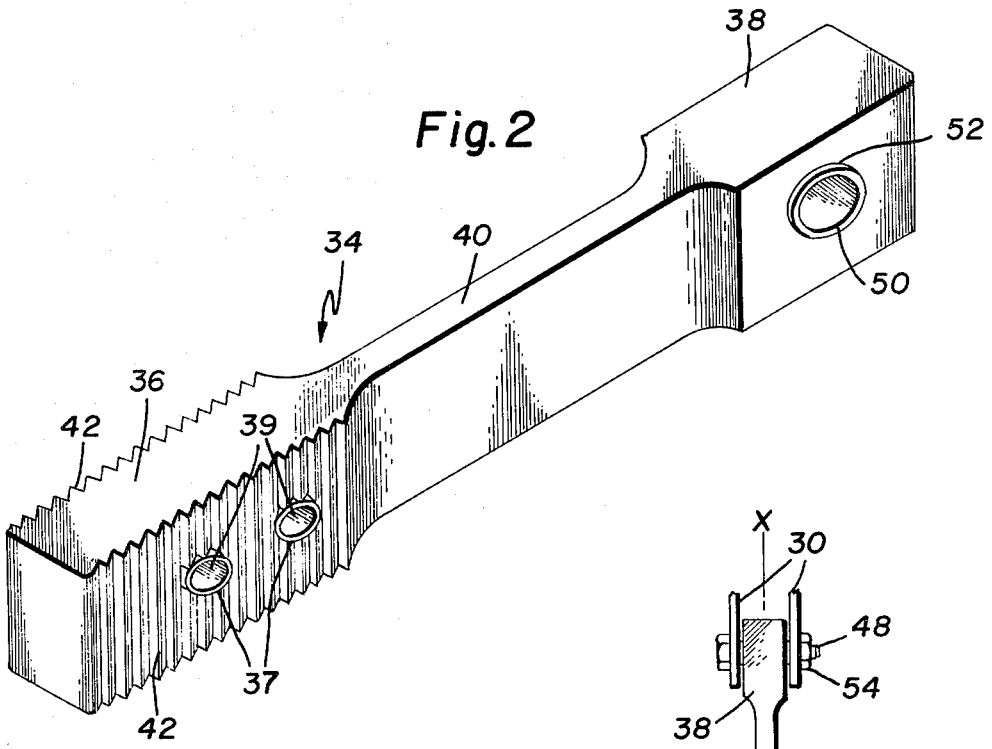
FIG. 2 is a perspective view of the lug strap connector of the present invention disconnected from the picking mechanism.
Figure 4:
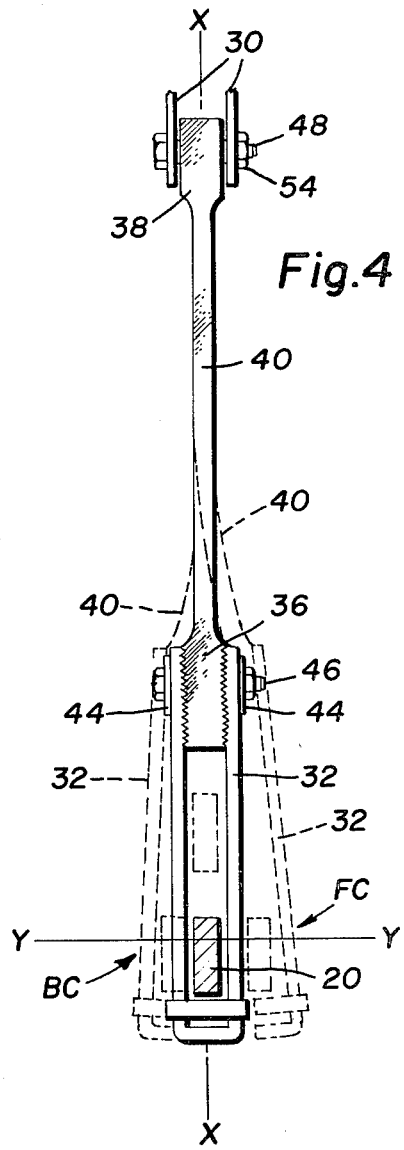
FIG. 4 is a fragmentary plan view with portions broken away showing the deflection of the lug strap connector of the present invention as the picker stick moves backwardly and forwardly with the lay.

A picker shaft 26 is mounted on the loom side 12 and includes a pick arm 28 comprising bifurcated end portion 30. A U-shaped lug strap 32 loosely straddles the picker stick 20 and is connected to the pick arm 28 by means of a lug strap connector, generally indicated at 34, made in accordance with the principles of the present invention. Lug strap connector 34 comprises an outer end 36, and inner end 38, and a narrow, rib-like intermediate portion 40 extending between ends 36 and 38. Referring to FIG. 2, the outer end 36 has a pair of horizontal holes 37 provided with suitable bushings 39. The vertical surfaces 42 of the outer end 36 are serrated as shown in FIG. 2. Surfaces 42 fit against matching surfaces on the inside of the extending legs of the lug strap 32, as shown in FIG. 4. The ends of the lug strap 32 are firmly clamped against the serrated surfaces 42 of the outer end by means of the pair of clamping plates 44 drawn together by a bolt 46 extending through one of the bushings 39 and appropriate holes or slots in the ends of the lug strap and plates 44.

Figure 3:
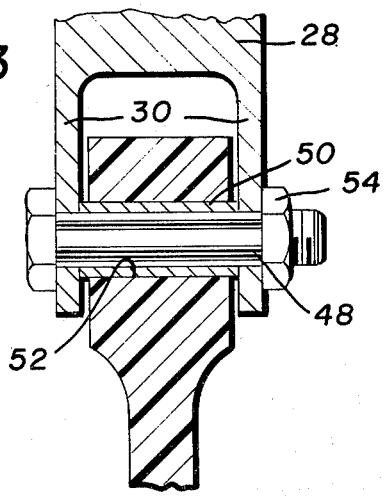
FIG. 3 is a fragmentary section taken through the pivotal connection between the pick arm and lug strap connector.
Figure 5:
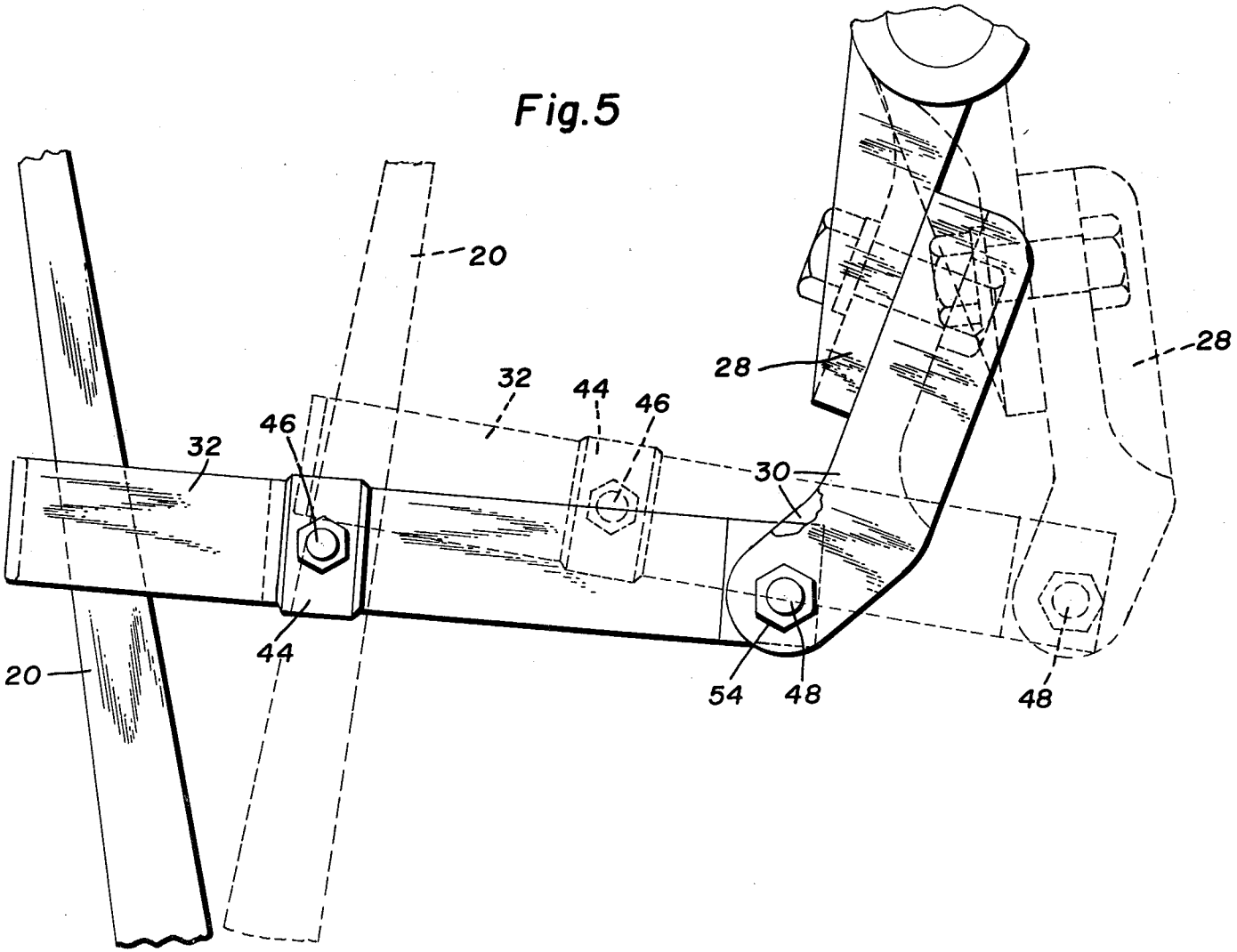
FIG. 5 is a fragmentary front elevational view showing the relative displacement of the various picking elements in FIG. 1 during a picking cycle.

The inner end 38 of the lug strap connector 34 is pivotally mounted between the bifurcated ends 30 of the pick arm by means of bolt 48 extending through a bushing 50 mounted in a sliding fit in a hole 52 extending through the inner end 38, see FIG. 3. Bushing 50 is slightly longer than hole 52, as shown in FIG. 3, so that, when a nut 54 is tightened on bolt 48, the bifurcated ends 30 of the pick arm 28 are drawn against the ends of the bushing to clamp the bushing therebetween. This enables the lug strap connector to rotate freely on the bushing 50, when the relative positions of the lug strap connector and pick arm 28 are changed during picking. The relative motion between these two elements is best illustrated in FIG. 5, wherein the full lines show the elements in their normal positions and the dotted lines show the elements at the end of a picking stroke.

Lug strap connector 34 is made of a flexible elastomer material, which in the preferred embodiment is a high density polymer, such as the high molecular weight polyethylene known as "ultra-high molecular weight linear polyethylene", or nylon.

The operation and advantages of the present invention will now be readily understood in view of the above description. After the shuttle 18 has arrived in the box 16, the picker shaft 26 is given a sharp, partial rotation by the drive means, not shown but well-known in the art. This motion is transmitted to the pick arm 28, causing it to move from the full line position to the dotted line position, as shown in FIG. 5. The motion of the pick arm 29 pulls the picker stick 20 from its full line position to the dotted line position, also shown in FIG. 5 by means of the lug strap 32 and lug strap connector 34. This causes the picker stick 20 to move sharply along the slot 22 for propelling the shuttle 18 out of the shuttle box toward a similar shuttle box at the other side of the loom. Picking generally occurs at the top center position at the time that the lay is roughly midway between its forward and rearward positions. During picking, picker stick 20 and the pick arm 28 are both in the first plane which extends across the loom. In this place, the picker stick, lug strap, and lug strap connector are aligned along their central longitudinal axes with no distortion, as shown in full lines in FIG. 4. The picker stick 20 is shown in its outer position immediately prior to the pick and will be moved to its inner position (shown in dotted lines in FIG. 4) at the end of the picking stroke. When the lay is in its forwardmost or rearwardmost position, commonly referred to as "back center" and "front center" positions, respectively, the picker stick will occupy the left and right hand dotted line positions, respectively, indicated in FIG. 4. These two positions are indicated by letters FC and BC for front center and back center, respectively in FIG. 4. The motion of the picker stick forwardly and rearwardly occurs within the second plane, indicated by the letters Y—Y in FIG. 4. Vertical plane Y—Y is at a right angle to the vertical plane X—X. As the picker stick 20 moves within plane Y—Y out of the X—X plane, it becomes misaligned with the pick arm 28, as shown in FIG. 4. This misalignment is compensated for to a limited degree by the fact that the lug strap 32 is loose on the picker stick and to a greater extent by the flexible nature of the lug strap connector 34. Lug strap connector 34 is able to flex from the fullline position to the dotted-line position, shown in FIG. 4, because of the resilient nature of the material from which it is made and because of the shape of the reduced, rib-like intermediate portion 40 which allows it to bend along this riblike section.

It can be seen, therefore, that the invention enables the lug strap connector to pivot along a single axis with respect to pick arm 28 in a manner which will provide for a minimum of wear and which will allow close tolerance between the pivoting elements, thereby providing for accurate, reliable, uniform picking. At the time of picking, the pick arm rotates along the full length of the bushing which is a favorable wearing conditions, as opposed to the "line contact" of a ball in the universal joints of the prior art designs. In addition, in the preferred embodiment of the invention, the lug strap connector is plastic and the bushing metallic. This represents a superior wear-condition, as compared to the metal-on-metal pivotal connections of same former designs. No lubrication of the moving parts is required and the maintenance is greatly reduced. The connection between the pick arm and lug strap connector is easily assembled and disassembled when replacement is necessary.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A lug strap connector for a loom picking mechanism having a swinging pick arm and a lug strap connected to a picker stick, said lug strap connected being made of high density polymer, comprising:

(a) an inner end for pivotal attachment to a pick arm,
(b) an outer end for clamping attachment to a lug strap, and
(c) an intermediate portion extending between the inner and outer ends and having a horizontal dimension which is substantially less than that of the outer and inner ends and substantially less than its vertical dimension.

2. The lug strap connector as recited in claim 1, wherein the vertical side surfaces of the outer end are serrated.

3. The lug strap connector as recited in claim 1, wherein the inner end of the lug strap connector end has a hole extending horizontally therethrough and the connector comprises a bushing slideably fitted in said hole to allow for rotation of the lug connector on the bushing.

4. The lug strap connector as recited in claim 1, wherein the outer end has at least one hole extending horizontally therethrough for reception of a bolt for attachment to a lug strap.

5. In a loom having an oscillating picking shaft and a picker stick mounted for oscillation in a first vertical plane and in a second vertical plane which is at a right angle to said first vertical plane, connecting mechanism comprising:

(a) a pick arm mounted for oscillation in said first vertical plane, one of the pick arm being fixed to the picking shaft,
(b) a lug strap, one end of which is mounted on the picker stick,
(c) a lug strap connector formed of flexible material having a hole extending horizontally therethrough, and in intermediate portion having a horizontal dimension which is substantially less than that of the outer and inner ends,
(d) means for clamping the outer end of the lug strap connector to the other end of the lug strap,
(e) a bushing slideably fitted in the horizontal hole in the lug strap,
(f) a pivot pin extending through the bushing, and
(g) means for clamping the bushing to the pick arm and pin so that relative motion occurs only between the lug strap connector and bushing, whereby the pivotal axis of the pivotal connection between the pick arm and lug strap connector is horizontal to allow for relative displacement of the pick arm and lug strap connector in said first vertical plane, and whereby the flexing characteristics of the lug strap connector allows for relative displacement between the picker stick and the pick arm in said second vertical plane.

6. In a loom as recited in claim 5, wherein the bushing is longer than the hole in the inner end of the lug strap connector.

7. In a loom as recited in claim 6, wherein the picker stick is mounted for oscillation in a first vertical plane and in a second vertical plane which is at a right angle to the first plane and wherein the pick arm is mounted for oscillation in the first plane, the pivotal axis of the pivotal connection between the pick arm and lug strap connector being horizontal to allow for relative displacement of the pick arm and lug strap connector in said first vertical plane, whereby the flexing characteristics of the lug strap connection allows for relative displacement between the picker stick and the pick arm in said second vertical plane

8. In a loom as recited in claim 7, wherein the inner end of the lug strap connector has a hole extending horizontally therethrough and the means for pivotally attaching the lug strap connector to the other end of the picker arm comprises:

(a) a bushing slidably fitted in said hole,
(b) a pivot pin extending through the bushing, and
(c) means for clamping the bushing to the pick arm and pin so that relative motion occurs only between the lug strap connector and the bushing.

9. In a loom as recited in claim 8, wherein the bushing is longer than the hole in the inner end of the lug strap connector.

* * * * *